United States Patent [19]

McCain et al.

[11] 4,050,686

[45] Sept. 27, 1977

[54] SHEET OR SIGNATURE FEEDING MACHINE AND METHOD

[75] Inventors: William B. McCain, Hinsdale; James F. Cosgrove, Western Springs; Edward J. Zagorski, Chicago, all of Ill.

[73] Assignee: McCain Manufacturing Co., Chicago, Ill.

[21] Appl. No.: 649,639

[22] Filed: Jan. 16, 1976

Related U.S. Application Data

[62] Division of Ser. No. 441,056, Feb. 11, 1974, Pat. No. 3,966,185.

[51] Int. Cl.[2] ..... B65H 39/02

[52] U.S. Cl. ..... 270/54

[58] Field of Search ..... 270/10–15, 270/37, 43–58

[56] References Cited

U.S. PATENT DOCUMENTS

| | | | |
|---|---|---|---|
| 1,264,753 | 4/1918 | Barber | 270/37 |
| 2,568,604 | 9/1951 | Bechberger | 270/54 |
| 2,793,032 | 5/1957 | Van Dusen | 270/58 |
| 2,873,112 | 2/1959 | Crafts | 270/55 |
| 3,008,705 | 11/1961 | Heigl | 270/54 |
| 3,057,620 | 10/1962 | McCain | 270/53 |
| 3,237,934 | 3/1966 | Rosenberg | 270/53 |
| 3,260,517 | 7/1966 | Sather | 270/58 |
| 3,414,257 | 12/1968 | Muller | 270/54 |
| 3,522,942 | 8/1970 | Hepp | 270/55 |
| 3,664,655 | 5/1972 | McCain | 270/54 |
| 3,730,512 | 5/1973 | Bellanca | 270/53 |

*Primary Examiner*—Edgar S. Burr
*Assistant Examiner*—A. Heinz
*Attorney, Agent, or Firm*—Kinzer, Plyer, Dorn & McEachran

[57] ABSTRACT

Books are produced by feeding juxtaposed webs of printed matter, obtained from rolls, to a knife which cuts the webs to provide juxtaposed sheets in paginated relation; a delivery cylinder may be optionally set to feed the paginated sheets to one of two folders, which respectively fold signatures of different form. The signatures are then delivered to a conveyor which is preferably a saddle conveyor in which event the fold is so made as to result in a lap margin.

4 Claims, 23 Drawing Figures

UPSTREAM SIGNATURE FEEDER (375)
SIGNATURE FOLDER (340)
DOWNSTREAM SIGNATURE OPENER (355)
LAP
LAP 255-1
255-2
255-3
255-4
256-1
256-2
256-3
256-4
295
BG
PAGES 1,16
(INVERT)
EJECT
TRIMMER
416
415
418
419
FROM FOLDER
LAP
251
PAGE 1
TO DIVARICATOR
BOOK DIVARICATED FOR SADDLE CONVEYOR
BACKBONE
PAGE 16
PAGE 8
LAP MARGIN
SHORT MARGIN
250
PAGE 9

SHEET OR SIGNATURE FEEDING MACHINE AND METHOD

This is a division of application Ser. No. 441,056, filed Feb. 11, 1974 now U.S. Pat. No. 3,966,185.

This invention relates to sheet handling apparatus and in particular to machines for gathering signatures, a signature being a folded sheet that is to become part of a book such as a magazine.

Signature gathering machines are primarily of two kinds. There is the saddle gatherer in which the sheets of the signatures are spread apart and dropped on a support which is in the form of two plates forming an inverted *V* from which the "saddle" designation is derived. This saddle support extends past the hoppers or pockets from which the signatures are fed, and a conveyor chain presenting feeder pins moves along a slot at the top of the saddle support in such fashion as to move the first signature on the saddle support to the second pocket where the second signature is gathered atop the first one, the procedure being repeated at each successive pocket until all the signatures comprising the book have been gathered one atop another. The signatures thus gathered by the saddle type gatherer have their backbones or folds nested one in another and are joined by staples applied colineally with the fold line at the backbone of the book. A magazine thus produced is the familiar one where the piercing ends of the joining staples are revealed when the magazine is spread at the center. In effect staples penetrate only half the pages.

The other principle type of signature gatherer, the flat gatherer, is characterized by feeding the signature in flat form, on their sides, so to speak, to a conveyor. Again, the conveyor moves past the pockets which contain the signatures, and the signatures are fed out of the pockets as the conveyor moves therepast the signatures are collected one on top of the other. In the instance of flat gathering, the backbones of the signatures, instead of being nested one inside another, are juxtaposed one on another to present a square back rather than a V-shaped back for the book, the staples penetrating the book from front to back, transverse to the backbone; or no staples at all, as in glue binding, or perfect binding.

The present machine embodies features of saddle gathering and flat gathering in that signatures in a flat state are divaricated to fit a saddle conveyor and are then conveyed to a saddle stitcher.

For many years book binders employing signature gathering machines have been confronted with a labor cost recognized by many experts in the field as constituting a productivity impediment, and impediment which experts have sought to surmount without practical success. The impediment is that persons must be engaged in constant attendance at the signature gathering machine, loading the hopper with signatures, and other persons must be necessarily engaged in maintaining the line of supply which literally extends to the loading dock of the plant where the signatures are printed and folded. It can be said in fact that the rate of gathering signatures is limited by the manual effort of keeping the hoppers filled.

A large number of hoppers supplying the gathering chain presents another and quite different problem, namely space, because the usual arrangement is linear, covering a stretch of considerable length.

We have addressed these problems for a long time, particularly in terms of utilizing space to better advantage, and also in terms of the technology set forth in U.S. Pat. No. 3,730,512, where books are produced as an incident to unwinding rolls of printed, paginated webs of water. Under the disclosure of that patent, the webs are registered in juxtaposed relation and glue is deposited between the webs at the page separations; afterwards the webs are cut along the glue lines to produce separate, individual sheets which may then be collected and bound as case bound of perfect bound books.

We have experimented at considerable cost and time for the past several years with ways to produce glue-backed signatures as distinguished from individual sheets glued back-to-back along their free edges. We had in mind an object of the present disclosure to produce books from signatures that need not necessarily be stitched and in which production would not require hoppers for storing the signatures.

It was ultimately realized that a previous experience of ours, furnished a clue. The clue was the idea of feeding signatures in a flat state to a so-called gathering chain which in turn would advance the signatures one-by-one to a signature opener (lap opener) where each signature is divaricated or opened as an incident to gathering like-fed signatures on a saddle-type conveyor employed for saddle stitching.

The present disclosure, then, embraces an elaboration and synthesis stemming from two unrelated concepts. The synthesis is the concept that the proposal of registered, juxtaposed, paginated webs as in U.S. Pat. No. 3,730,512, could be modified to create flat signature pre-forms of double page width represented by glue-joined sheets severed from the webs, fed by the aforesaid flat gatherer to a folder, folded along the glue joint to create a folder signature with a glued backbone, and the folded signature then divaricated to fit a saddle conveyor. The signature would be unusual in being folded along a glued back and presenting eight glue-interlocked pages in the instance of two juxtaposed webs of double page width.

The flat gather could feed at right angles to the saddle conveyor, allowing additional signature feeders to be used either upstream or downstream of the delivery point of the glued signature. Registration of the juxtaposed sheets would be maintained by the glue joint; the adhesive, being wet, would facilitate a good fold. By using web feed to create signatures, the problem of loading hoppers is substantially reduced.

The aspect of the present invention under consideration contemplates continuous production of signatures, and books composed of the signatures, by unwinding rolled webs of printed material and collating the unwound web material. This, as noted, avoids the need to attend and load many hoppers as heretofore required for gathering signatures into groups, although practice of the present invention is flexible enough to allow for utilization of ordinary hopper supply, preserving an investment. In fact, as will be appreciated from the disclosure, the invention fulfills another objective which is to introduce a new way of making books by using and therefore conserving known equipment.

Under the present invention, in the preferred mode of practice, printed webs of double-page width are unwound from rolls and accurately collated or registered in head-to-foot relation (pagination) by means of register pins fitting register holes at one edge of each web. A line or bead of glue is applied between the webs longitudinally, establishing an interlock which holds the registry. The webs as thus joined are fed to a cutting cylinder which severs the webs transversely at repeat lengths.

The bead of glue is slightly off center inasmuch as we want the register openings to be presented at a lap edge of a folded signature. To this end the severed sections are delivered to a folder, which folds the sheets along the glue line to create a signature. The presence of the glue, wetting the sheets, facilitates folding.

The resultant signature consisting of the folded sheets has a glued backbone. The signature is fed from the folder to a lap opener of known form where the glue-backed signature is divaricated to fit a saddle conveyor to which it is delivered as an incident to divarication.

Other signatures may be added upstream or downstream of the point of delivery of the glue-backed signature and are gathered into a book on the saddle conveyor. The book group is calipered for the presence of a signature having a splice. Thereafter the signature group is conveyed to a saddle stitcher.

In the instance of using a saddle stitcher, if an imperfect signature having a splice is detected, the stitcher heads are disabled for that particular signature group. The signature group containing the imperfect signature is ejected.

After passing the stitcher head, the bound signatures are delivered to a trimmer where the lap edge containing the register holes is separated as waste. The head and foot may also be trimmed.

The preferred mode of production may be varied, of course, and other modes of production may be employed. Therefore, other and further objects of the present invention will be apparent from the following description and claims and are illustrated in the accompanying drawings which, by way of illustration show preferred embodiments of the present invention and the principles thereof and what is now considered to be the best mode contemplated for applying these principles. Other embodiments of the invention embodying the same or equivalent principles may be made as desired by those skilled in the art without departing from the present invention or from the subject matter of the claims.

PRODUCTION OF GLUE-BACKED BOOKS FROM ROLLED WEBS

Figure 1:
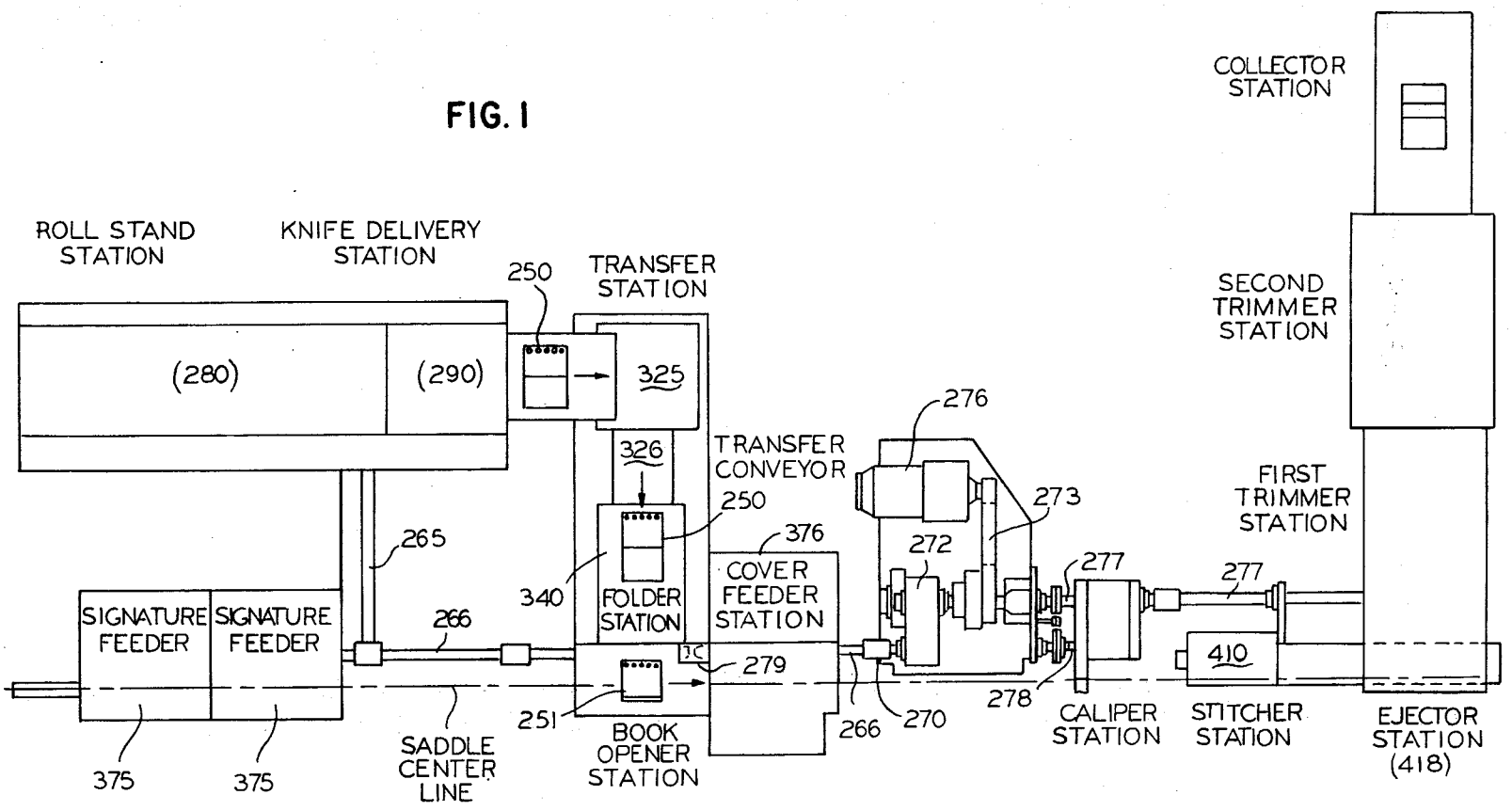
FIG. 1 is a partly diagrammatic and partly schematic drawing of the means employed under the present invention to make signatures and produce books therefrom.
Figure 2:
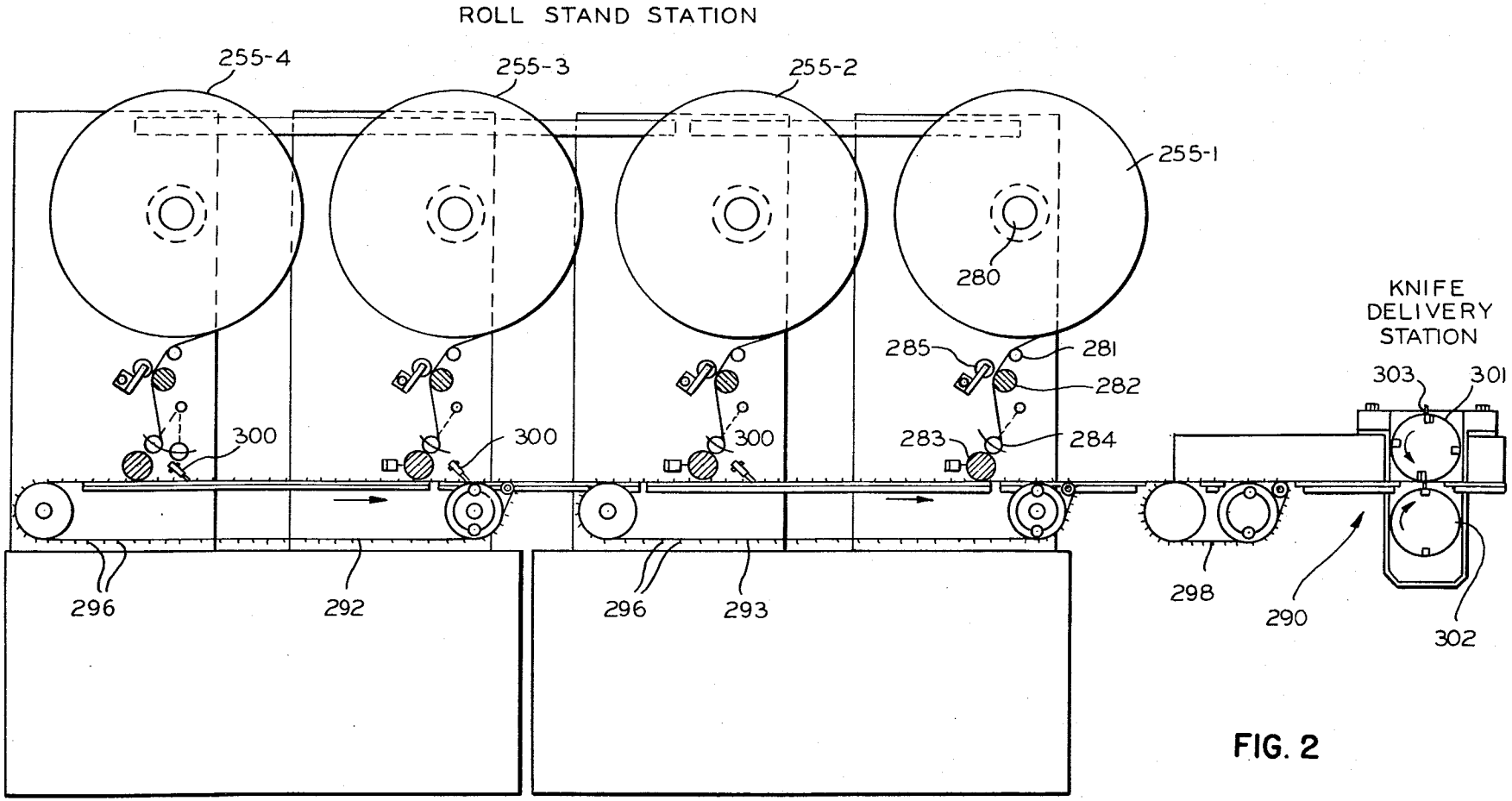
FIG. 2 is a sectional view of the roll stand and the knife delivery means.

FIG. 1 is a schematic, partly diagrammatic plan of a system for producing glue-backed books from rolled webs. The rolls of web material, pre-printed in page relation, are assembled at a roll stand station. As shown in FIG. 2, the webs are withdrawn from individual rolls, glued, collated, and fed to a knife delivery station where the registered webs are severed transversely. The product obtained at the knife delivery station may be viewed as a multiple page pre-form signature, one not yet folded, but in any event a multiple page assembly of sheets, identified by reference character 250 in FIG. 1. This structure pre-form is advanced to a transfer station, FIG. 1, and from thence at right angles along a different path to a folder station by way of a transfer conveyor. The sheet material transferred to the folder station is essentially in the same form, 250.

The juxtaposed sheets are folded into signature form and fed to a book opener, FIG. 1, thereby preparing the book 251, FIG. 1, for delivery to a saddle conveyor. The book has a glued back.

As shown in FIG. 1 individual signature feeders may be located upstream of the book opener and a cover feeder may be located downstream. In other words, the glued book at the book opener station may itself be deposited atop signatures delivered by the saddle conveyor to the book opener station, and afterwards a cover (in reality another signature) may be juxtaposed at the cover feeder station.

The book thus assembled from the gathered signatures is delivered by the saddle conveyor to a caliper station and from thence to a stitcher station which will be utilized only in the event the upstream signature feeder and/or the cover feeder are active. Thus, if the only product is the glued back book 251, FIG. 1, the stitcher heads will not be activated; however, if another signature is to be gathered with the book 251, then the stitcher station will be activated.

If an imperfect book is detected by the caliper, the stitcher heads, if used, are disabled; the insufficient book is discarded at the ejector station, FIG. 1, prior to delivery to the trimmers where the front, head and foot of the book are trimmed resulting in the finished product.

FIGS. 11 through 15, the stages of constructing or composing the glue-backed book (sixteen pages) are shown. Assuming there are four roll webs at the roll stand, rolls 255-1, 255-2, 255-3 and 255-4, the webs unwound are, respectively, 256-1, 256-2, 256-3 and 256-4. In connection with the disclosure thus far made it is important to bear in mind that the unwound webs are fed forwardly in the direction of the arrows shown in FIG. 2. Web 256-1 is laid down first on a pin register belt as will hereinafter be described, and the remaining webs, in the order identified, are juxtaposed one atop the other on web 256-1.

Figures 11, 12, 13, 14, 15, 16:
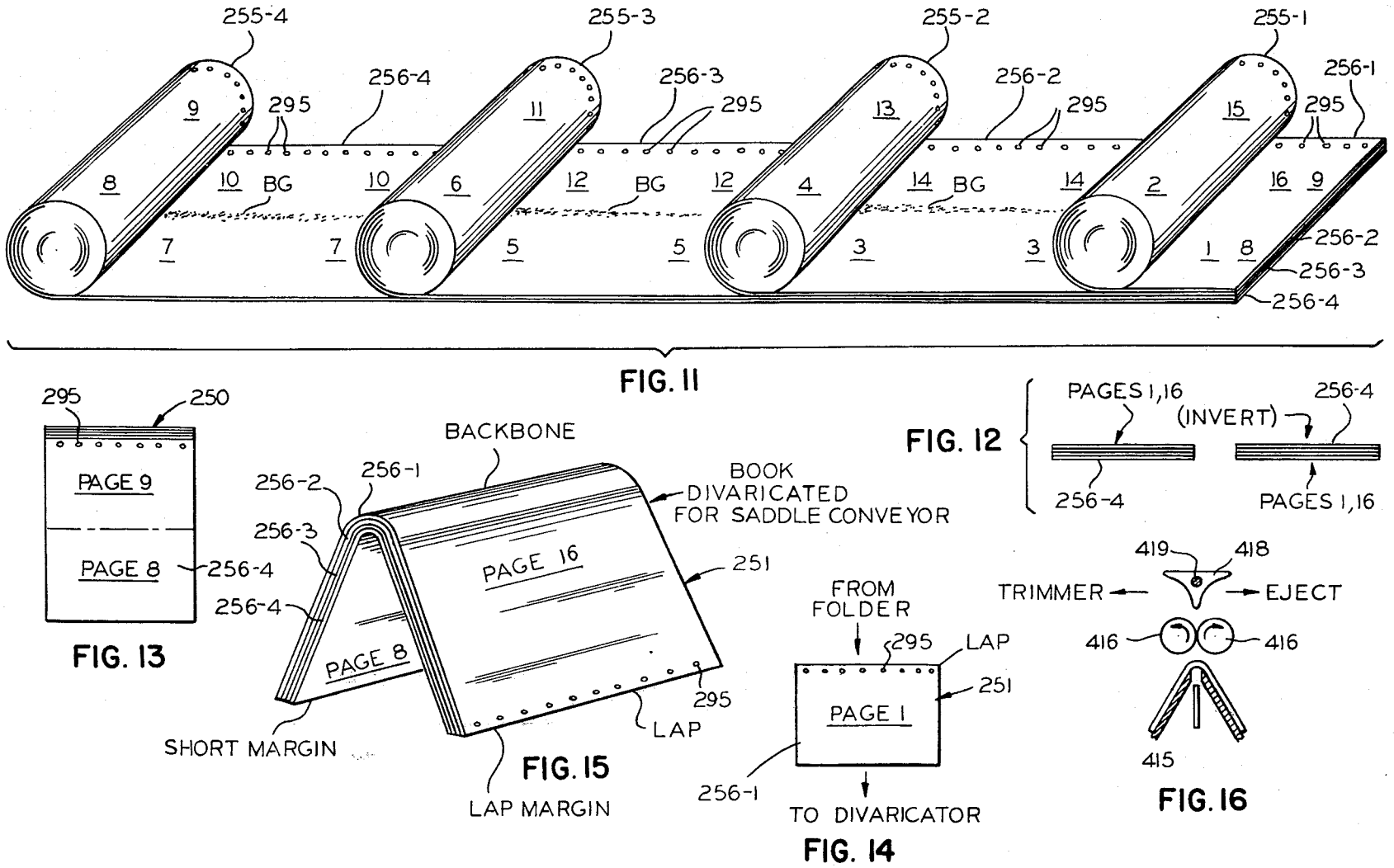
FIGS. 11 through 14 are views showing the steps of book production.
FIG. 15 is a detail schematic view of a selector means.
FIG. 16 is a detail view of means for splicing.

A representation of pagination is shown in FIG. 11. The webs are of double page width, printed on both sides, so that roll 255-1 may be considered as printed on one side with page 1 and 16, pages 2 and 15 appearing on the reverse side. The remaining webs are correspondingly paginated to produce a sixteen page book.

When the webs are juxtaposed and properly registered, FIG. 12, there is a constant stream of signature pre-forms being produced at the knife station. It must be remembered, however, that the illustration given for pagination is related to only one form of production herein disclosed wherein four rolls are used and wherein the juxtaposed sheets are inverted as hereinafter disclosed, among other things.

As shown in FIG. 1 and as mentioned above, the pre-form book or signature product emerging from the knife station is identified by reference character 250; it is two pages wide, not yet folded at the backbone. At the transfer station this product, considered as a juxtaposition of four sheets, is inverted, FIG. 12, and transferred to the folder station at right angles to its original delivery path as shown in FIG. 13. This sheet assemblage is folded for delivery to the book opener station and the folded product is identified by reference character 251 in FIGS. 1 and 14. At the book opener or divaricating station, the previously folded book is opened, FIG. 15, incidental to depositing it on the saddle conveyor.

The four rolls are supported on spindles 280. The unwound length of the web is trained about an idler roll 281, then around an infeed roll 282 and from thence between a guide roll 283 and associated dancer roll 284, the latter being used as a control brake to regulate the rate of web feed. Roll 283 guides the web into a pin register belt to be identified below.

The feeder roll 282 is driven positively so that it together with an associated nipper roll 285 is responsible for withdrawing and feeding the web material from the web rolls to the pin register belt.

The web material is advanced in the direction of a rotary knife assembly 290, FIG. 2, constituting the knife delivery station, and this is accomplished by laying the webs, one atop another, on a pair of tandem end-to-end pin register belts 292 and 293 travelling beneath the spindles. At the commencement of a run, the leading ends of the webs are accurately registered in page to page relationship by the supervisor, and this is accomplished in part by providing punched, pin register openings 295 spaced equidistantly from one another along one edge of each web. The register belts 292 and 293 are provided with feed pins 296, spaced in accordance with the register openings 295. The register openings are only at one edge of the webs for reasons to be explained.

The pin feeders 292 and 293 simply perform a registering and collecting function. Thus, the principal means for feeding and advancing the webs is represented by the engaged rollers 282 and 285; the pin register belts do not pull the web material from the rolls but merely maintain forward motion of the juxtaposed webs, moving the juxtaposed webs forwardly to a third register pin belt 298 which advances the juxtaposed webs to the knife assembly 290.

In accordance with the present invention, a bead of glue BG, FIG. 11, is deposited substantially midway of the width of each of the webs 256-2, 256-3 and 256-4. In other words, the bead of glue separates adjacent printed pages on a web. The bead of glue is slightly off center, in view of the way the juxtaposed sheets are to be folded, and for this same reason the register openings are confined to one edge of the webs. Thus, the register openings serve no purpose in the completed book and may be trimmed off. This being so, and since we desire to conserve investments already made in equipment for producing saddle-bound books, each bead of glue is deposited continuously and longitudinally on the line which constitutes the glued back bone of the book (see FIG. 15); hence when a signature is made the register openings are presented at what constitutes the extended lap margin (see FIG. 15) of the folded sheets.

Each bead of glue is deposited by a nozzle 300, FIG. 2. The glue may be a "hot melt", supplied from a reservoir, not shown.

The knife assembly 290 includes a rotary knife holder 301 and an opposed rotary anvil 302. The knife holder 301 carries two 180° displaced knives 302, each effective to sever the juxtaposed webs transversely, that is, at right angles to the glue bead. The transverse cuts are made repeatedly of course, cutting at the head and foot of successive pre-form books, resulting in a constant stream of a four juxtaposed sheets to be folded along the glue line. Head-to-foot registration of the juxtaposed pages is maintained by the glue. The product produced at the knife station is to be folded along the glued back; the preferred manner of accomplishing this will now be described.

As will be apparent in FIG. 1, the path of movement of the web material from the roll stand to the rotary knife is parallel to the saddle conveyor, but this direction is turned 90° at the transfer station incidental to delivering the sheets to the folder station where the sheets joined by glue are folded to signature form. The means for accomplishing this transfer are shown in FIGS. 3 and 4.

Figures 3, 4:
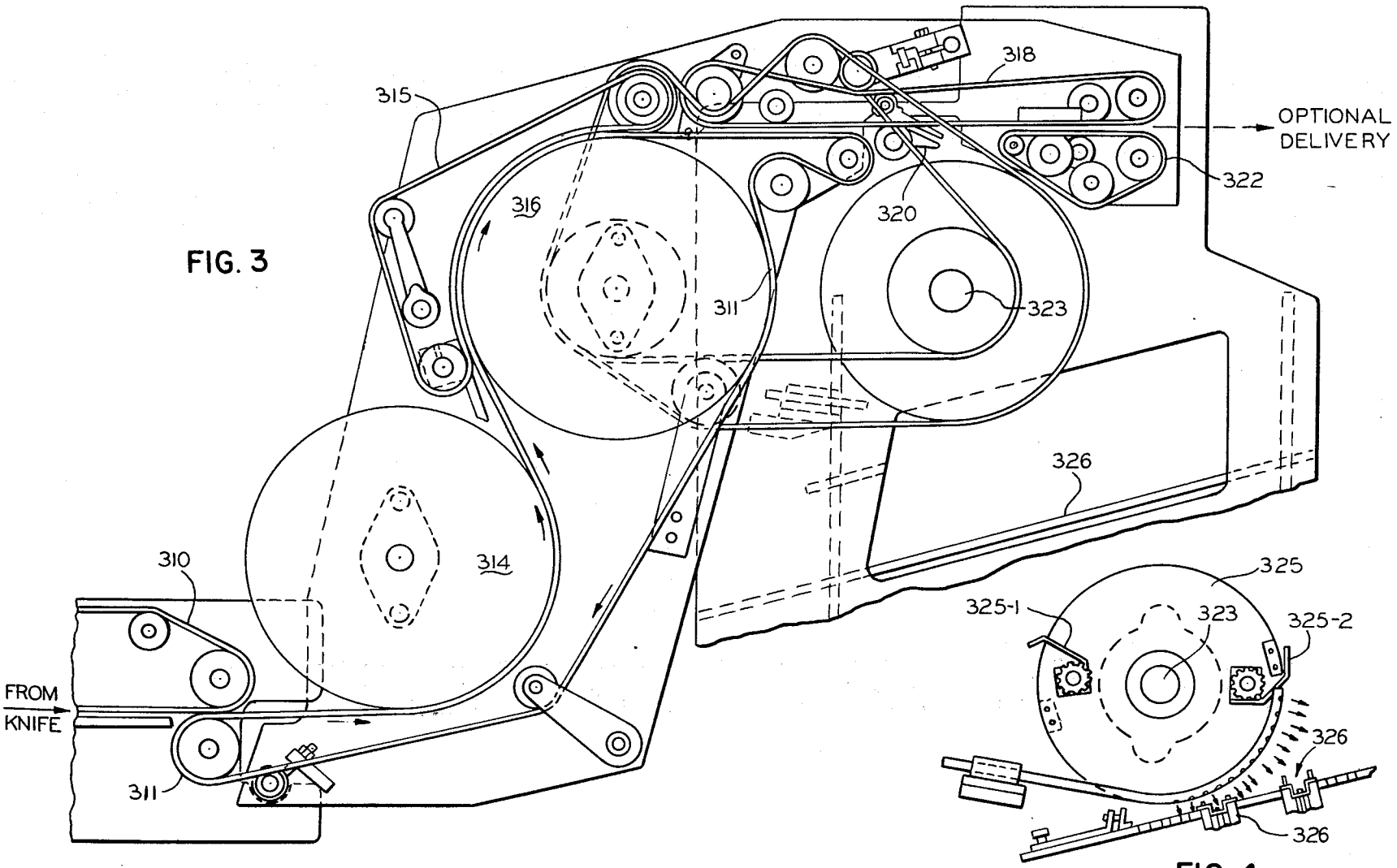
FIG. 3 is an elevation of means employed to transfer sheet material from the knife delivery to the folder.
FIG. 4 is a side elevation of a delivery cylinder.

The book or signature pre-forms, constantly separated from the webs by the rotary knife, are fed horizontally one by one to the bight of engaged feed belts 310 and 311, FIG. 3, the latter being trained around rotary guide discs 314 so that the glued, registered sheets are elevated and moved upwardly. This gain in altitude is accomplished because the roll stand and rotary knife are at one level for convenience while the transfer conveyor (326, hereinafter) is at another level.

Another series of feed belts as 315 are opposed to the belts 311 and belts 311 are extended to another set of rotary guide discs 316. From thence the pre-form signatures or books are fed forwardly by means of additional feed belts 318 opposed to the feed belts 311, and at this point a shiftable means as 320 is selectively operable to deliver the sheet material either to a transfer cylinder or, optionally, to feed belts 322 which are opposed to the feed belts 318.

The aforementioned transfer cylinder to which the books may be delivered by guide 320 is co-axial with shaft 323, FIG. 3, and the transfer cylinder itself, 325, is shown in FIG. 4, positioned above the transfer conveyor 326 which transfers the books to the folding station.

Figure 8:
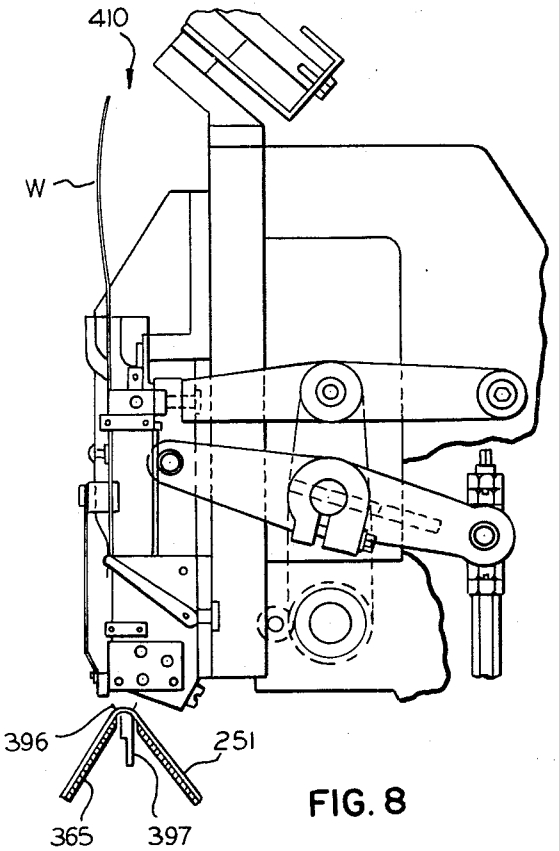
FIG. 8 is an elevation of the stitcher head.

The transfer cylinder 325 is similar in nearly all respects to the cylinder means 25 described in connection with FIG. 8, of our parent application Ser. No. 441,056, now patent No. 3,966,185 except of course that the sheet material fed to the cylinder 325 is not fed from a hopper or supply pocket but rather arrives from the knife station. Consequently, the details of the transfer cylinder 325 will not be repeated except to note that the grippers thereon 325-1 and 325-2, identical to the grippers 20-1 and 20-2 of our aforesaid parent application, FIG. 8, are displaced 180° and are effective to deposit two signature pre-forms on the conveyor 326 during each cycle of rotation. Furthermore, the transfer conveyor 326, similar to the conveyor 75 described in connection with FIGS. 4 and 5 of our aforesaid parent application, is disposed beneath the transfer cylinder to receive the sheet material released therefrom, transferring the same forwardly to the folding station.

It will be recognized that the pre-form books or signatures, four sheets thick and not yet folded, are inverted by the transfer cylinder 325. In other words, the pages that were uppermost on delivery to the feed belts 310 and 311 are lowermost on the transfer conveyor 326; see FIG. 13. This inversion will not take place in the event the selectively operable guide 320, FIG. 3, is in an elevated position for directing the glued sheet material to the optional feed means 318–322. Such optional sheet delivery may be used under many different circumstances as for instance where the saddle conveyor, instead of occupying the center line shown in FIG. 1, is turned 90° to be positioned adjacent the transfer station, represented by cylinder 325. Another instance of utilizing the optional delivery, FIG. 3, is in the event the web material repeats alternately different books, rather than a constant flow of identical books, requiring separation into divergent streams.

Figures 5, 6A, 6B, 6C:
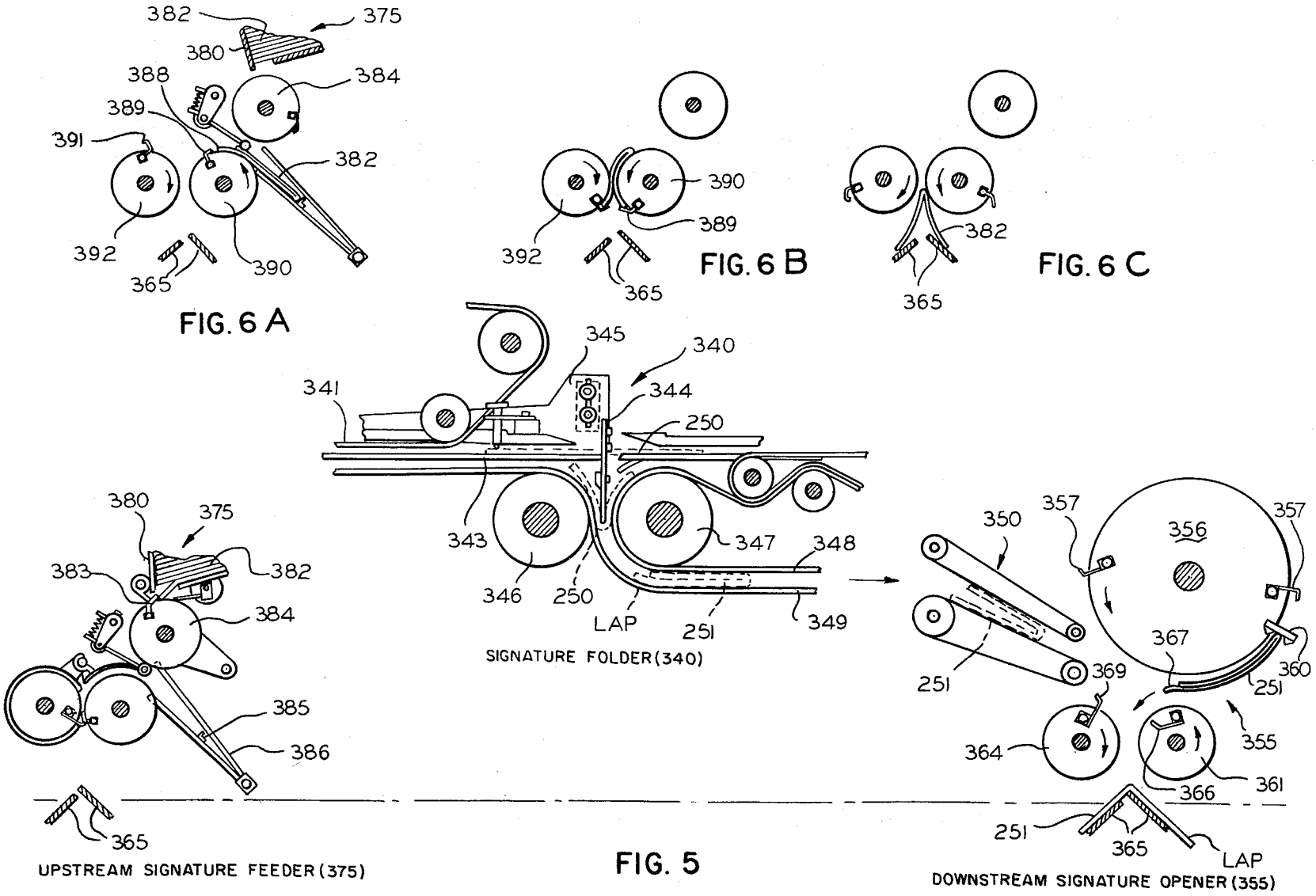
FIG. 5 is an assembly view of a folder, a signature feeder and a signature divaricator.
FIGS. 6A, 6B and 6C are sectional views showing the sequence of signature delivery.

Assuming the production circumstance where the flow from the knife is repeatedly an identical book, the cylinder 325, FIG. 4, is active and the book material 250, FIG. 13, presents the register openings 295 in a trailing position in the course of transfer to the folding means 340 shown in FIG. 5.

The folding means 340, FIG. 5, is disclosed in full detail in U.S. Pat. No. 3,749,394. Thus, the unfolded sheet material, still maintained in registry by the glue, is fed forwardly by feed belts as 341 until the leading end is engaged with a stop, not shown, so that the sheet assembly 250 spans the gap presented by a pair of spaced support plates 343 and 344. At this time a folder or tucker blade 344 carried by a reciprocal support 345 is in an uppermost position; it then descends to force the signature material between a pair of folder rollers 346 and 347. The space between the folder rollers is exaggerated in FIG. 5 for clarity. A neat, sharp fold is indeed made. In fact, a sharp fold is facilitated by the glue beads which are still somewhat moist. The folder blade support is cycled constantly by a cam, not shown.

The emergent folded material 251, FIG. 5, is now of conventional signature appearance and the book or signature in its folded state is advanced by feed belts 348 and 349 to an intermediate feeder 350 associated with a signature divaricating means 355.

The signature divaricator 355 includes a transfer cylinder 356 having a pair of grippers 357, effective in each half-cycle of the machine to extract a signature properly positioned by the in-feeder 350, withdrawing the signature therefrom and moving it counterclockwise as viewed in FIG. 5 until the backbone or folded side of the signature is engaged with and released to a register gauge 360.

A pair of opening or divaricating cylinders 362 and 364 are located beneath the transfer cylinder 356. Cylinder 362 carries a gripper 366 effective to clamp the extended lap margin 367 of the signature positioned by the register gauge 360, extracting signature 251. Gripper 369, on the other hand, is effective to clamp the short margin or leg of signature 251 and together the two grippers 366 and 369 spread the two sections of the signature to fit the saddle 365 of the saddle conveyor.

The signature opening means 355 shown in FIG. 5 is of conventional and well known form consistent with one objective of the present invention to conserve an investment in existent production equipment and in fact the production method or system of the present invention assumes that the books emerging from the folder may optionally be gathered with other signatures and delivered by conventional equipment to the saddle conveyor, although such option may not always be employed. In this regard it has already been noted in connection with FIG. 1 that there may be one or more signature feeders 375 of conventional form located upstream of the book opener station. These additional, conventional feeders are sometimes referred to as "pocket" feeders, and there may be a similar cover feeder 376 downstream of the book opener station constituting the last signature to be added.

In any event, the upstream signature feeders may employ the opening means and operate on the principle shown in FIGS. 5, 6A. 6B and 6C wherein the sequence of signature feed and gathering, shown in detail, is virtually identical to the manner in which the book 251 is handled by the divaricating means 355.

Thus, as shown in FIGS. 5 and 6A, the upstream signature feeder 375 may include a supply hopper or pocket 380 containing a supply of additional pre-folded signatures 382. The backbone of each signature is in a forward or leading posiion and is pulled downwardly by a suction cup, not shown, so that the signatures may be extracted one by one by a gripper 383 carried by a rotatable transfer cylinder 384 which, during one cycle of revolution, extracts a signature 382 from the pocket 380 and releases it to a stop 385, FIG. 5, presented by a register gauge 386 as described in U.S. Pat. No. 3,087,721. This is done by the gripper 383 clamping the depressed backbone of the signature in the pocket 380, FIG. 5. The signature thus withdrawn from the pocket 380 and released to the register gauge 386 has the lap margin 388 thereof, FIG. 6A, in an extended or free attitude, in position to be clamped by a gripper 389 on an extractor cylinder 390. In timed relation, a gripper 391 on an opening cylinder 392 is effective, as shown in FIG. 6B, to clamp the short leg or side of the signature 382, all as disclosed in U.S. Pat. No. 3,087,721.

As in the instance of the opening cylinders 362 and 364, FIG. 5, the cylinders 390 and 392 are positioned above the saddle 365 of the saddle conveyor and once the legs of the signature have been sufficiently spread, FIG. 6C, the two grippers 389 and 391 are opened to release the signature 382 for gravity drop to the conveyor saddle 365.

Figure 7:
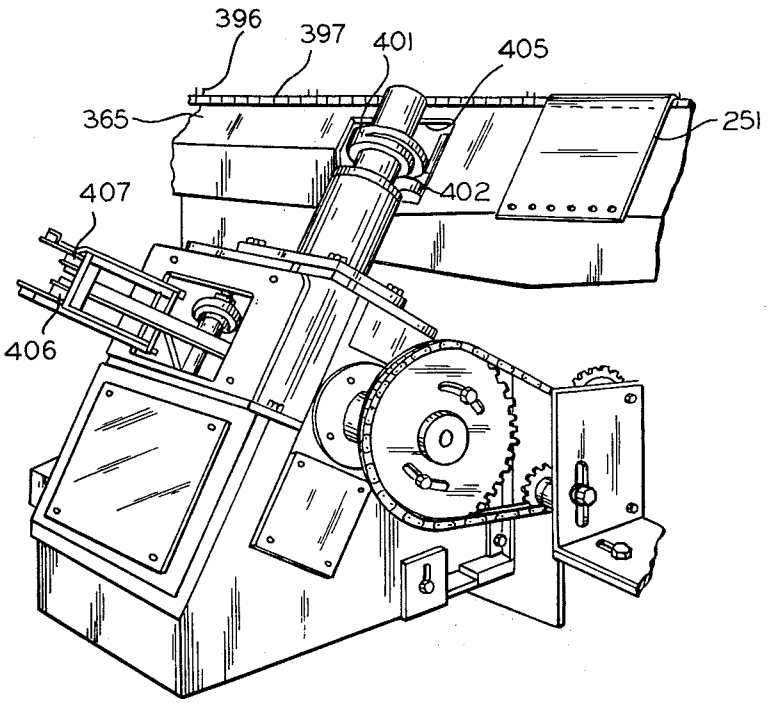
FIG. 7 is a perspective view of the caliper.

Under the embodiment of the invention thus far described it will be realized that one or more signatures may be collected on the saddle conveyor upstream of the book opener station and if this is so then book 251, FIG. 5, will be gathered on top of the signatures which were collected upstream. The book may be completed by a cover obtained from the cover feeder station 376. The signatures on the saddle 365 have the folded back uppermost. Feeder pins as 396, FIGS. 7 and 8, on a conveyor chain 397 project upwardly through a slot at the top of the saddle 365 and are effective to engage the trailing edge of the signatures, thereby aligning the trailing edges as an incident to moving the corresponding book to a caliper, FIG. 7, and from thence to the stitcher, FIG. 8, as will now be described.

The caliper station, as shown in FIG. 1, is upstream of the stitcher station. The caliper device, FIG. 7, comprises a pair of rollers or disc 401 and 402 opposed to one another within an opening 405 formed in one side of the conveyor saddle 365 The book 251 is transported between the rollers 401 and 402, where the thickness is measured and, as disclosed in U.S. Pat. No. 3,191,925, one or the other of a pair of control switches 406 and 497 is operated in the event the calipered book is one of incorrect thickness. The information represented by actuation of a switch 406 or 407 is stored during those cycles of the machine required for movement of the calipered book to the stitcher head 410 shown in FIG. 8, whereupon the stitcher head is disabled from applying staples to the backbone of the book. Disabling of the stitcher may be accomplished by disabling the wire feed gripper as disclosed in U.S. Pat. Nos. 3,191,925 and 3,305,154, or it may be done by displacing the wire W, FIG. 8, from the wire gripper as disclosed in U.S. Pat. No. 3,275,210.

The caliper is of particular importance in detecting incorrect books due to splicing the leading ends of fresh web rolls to the trailing ends of the exhausted webs. The splice, of course, represents an overlap of web ends and renders the book entirely unacceptable.

The saddle conveyor chain 397 is of the endless type, Its forward travel from the feeders 375 terminates at the point where the book is removed one cycle from the stitcher head and at this point the conveyor chain starts its return run or flight. The stitched book is advanced through and from the stitcher station to the trimmers, but an incorrect book is first ejected as will now be described.

The saddle 365 extends to the ejector station. The saddle has an open slot at the top as already noted. Reciprocal pusher fingers, not shown, are operative in the slot to move the stitched book into, through and out of the stitcher and into the ejector station.

Referring to FIG. 16, a vertically moveable tucker blade 415 identifies the ejector station, FIG. 1. The tucker blade 415 is effective to transport the stitched book upwardly into the bight between a pair of upfeeding rollers 416 which feed the book to an ejector guide finger 418. The ejector guide finger 418 is carried on a rock shaft 419 which may be oscillated clockwise or counterclockwise depending upon whether the book is to be trimmed or ejected. Thus, as noted above, a book of incorrect thickness is to be ejected, particularly in the instance of a book containing web end splices. Accordingly, when the caliper detects such an imperfect book, this information is stored until the book arrives at the ejector station, whereupon the ejector finger 418 is rocked clockwise as viewed in FIG. 16, ejecting the book and preventing its being delivered to the trimmer. On the other hand, if the book is acceptable then the ejector finger 418 is rocked counterclockwise, guiding the book to infeeding tapes 425, FIG. 9, which advance the book to a collector wheel 426 as a preliminary to positioning the book for trimming off the lap edge which contains the register openings.

Figure 9:
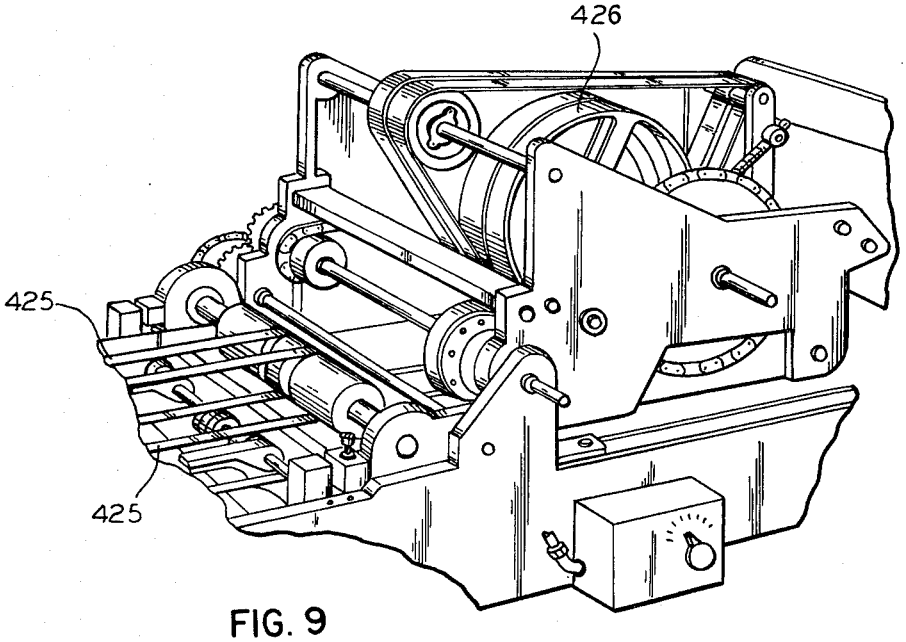
FIG. 9 is a fragmentary perspective view of a trimmer and associated collater.
Figure 10:
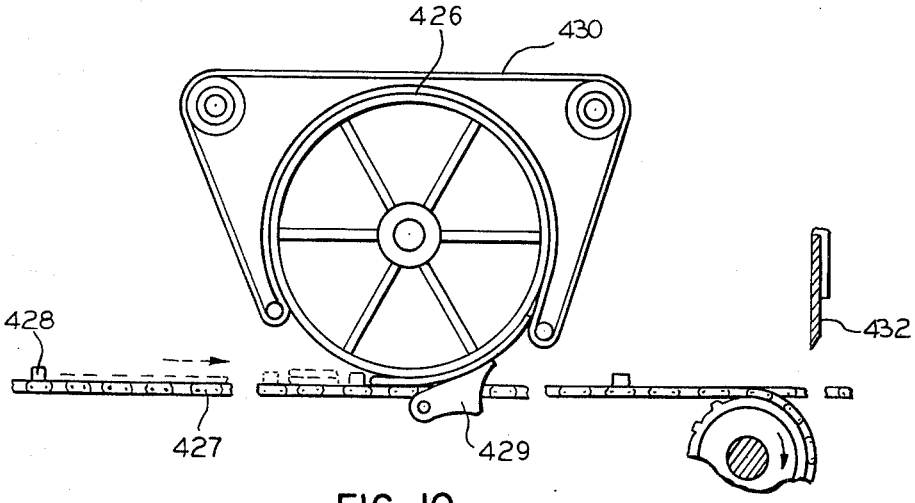
FIG. 10 is an elevational view of a portion of the structure shown in FIG. 9.

The trimmers, both in the first trimming station and second trimming station, may be of any desired form; head and foot trimming may not always be necessary. The trimmer shown in FIGS. 9 and 10 is of the kind disclosed in U.S. Pat. No. 3,520,395 but other forms may be used.

The infeeding tapes 425 feed the book to be trimmed to a conveyor chain 427 having feeder lugs 428. A guide finger 429, for each alternate book, is elevated to the position shown in FIG. 10, guiding the alternate book upward to the collector wheel 426 which, in cooperation with bands 430, elevates the book and inverts it, returning it to the conveyor 427 where it is dropped atop the trailing book. In this manner, as explained in U.S. Pat. No. 3,520,395, two books are juxtaposed on the conveyor 427 and are delivered forwardly a reciprocal knife 432 which is effective to trim the trailing, lap margins of the juxtaposed books, thereby removing the lap as waste paper.

Finally, the books are advanced to a second trimmer station where the head and foot are neatly trimmed.

Timing

The operating members at the roll stand and knife delivery station, FIG. 1, are driven by a shaft 265 in turn driven through proper gearing (not shown) by a shaft 266. Shaft 266 drives the conveyor chain associated with the saddle conveyor and in turn is driven through a coupling 270 and gear reducer 272. The gear reducer 272 is driven by a belt 273 in turn driven by a motor 276.

The gear reducer 272 is also used to drive a shaft 277 which drives the stitcher heads, the ejector and the equipment at the trimming station. A shaft 278 for driving the caliper is geared to shaft 277.

The equipment at the transfer station and the folder are driven through a clutch 279 which receives its input from shaft 266.

Shaft 266, it will be seen, may be driven through the gear reducer 272 at any selected speed, thereby determining the rate of travel of the conveyor. Shaft 277 will be driven at the same speed, and consequently shaft 278 is synchronized to shaft 266. This is equally true of shaft 265 and consequently, by means of gears, there is assurance that the rate of delivery of web material to the knife station, from which a book is to be made, is the same as the rate at which the saddle conveyor moves books past the book opener station. By the same token since the folder, transfer conveyor and inverting cylinder 325 are driven through clutch 279, the rate of delivery of signatures emerging from the folder is the same as the rate at which the saddle conveyor moves books to and through the book opener station. It may be noted that since the cylinder 301 has two knives and since the cylinder 325 carries two grippers, these rotary members are geared to turn at half the speed of shaft 266. Thus, the rotary knife cuts two complete books (head and foot so to speak) per 360° while cylinder 325 delivers two books per 360° to the transfer conveyor.

It may be further noted in connection with timing that the diverting finger 320, FIG. 3, may be operated alternately to direct signature pre-forms to a second cylinder (not shown) as 325 along a path co-axial with the path of the registered sheets emerging from the knife station. This second cylinder would deliver pre-forms to a second transfer conveyor as 326 leading to a second folder as 340. In other words there would be several parallel paths 326, FIG. 1, each eventually delivering a divaricated signature to the saddle conveyor or other gathering device. Such a scheme would be employed in those instances where the printed rolls on the spindles are printed with alternate signature pages.

Flat gatherings may also be utilized where perfect binding is desired; again, the signatures are gathered in juxtaposed relation and bound at their backs, but a square back results.

Splicing

Figure 17:
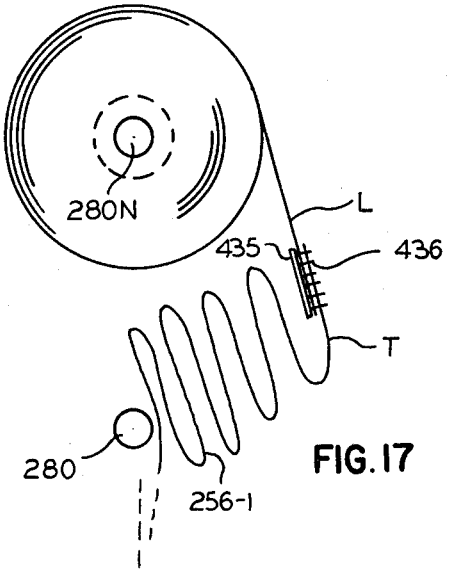
FIG. 17 is a diagrammatic view of a modified form of floor plan.

In an instance where it is desired to operate the machine continuously without stopping the machine to change rolls, this can be accomplished by a slight modification at the roll stand enabling the leading end of a fresh web on a spindle to be spliced to the trailing end of the web being exhausted. Referring to FIG. 17, the machine operator, detecting that spindle 280 holding web 256-1 is nearly exhausted, has festooned the remaining twenty or so feet of web 256-1. A new spindle, 280N uppermost on the spindle support, FIG. 17, supports a fresh roll of the printed web. A fixture plate 435 having register pins 436 spaced to fit the register openings in the trailing end T of web 256-1 and in the leading end L of the new web is used to bring the two ends together in overlapping relation, whereupon the operator simply applies a length of splicing tape cross-wise of the ends to join the web ends. Printed webs of the kind involved have registering indicia (color codes) along one side which may be used to assure the splice is made at the proper gauge, that is, to assure the web ends are so overlapped that the new web is indeed a precisely pages continuation of the other.

Modified Flow for Different Books

In actual practice the webs referred to above have a seventeen and one-half inch width (nominal seventeen inches herein) which, allowing for trimming of the lap edge containing the register openings, constitutes two pages each of eight and one-half inch width. The knife cuts the webs at eleven and three-eighths of an inch interval (nominal eleven inches herein) which, allowing for head and foot trimming, means a head-to-foot length of eleven inches. In other words, the signatures, once folded and trimmed, are of standard $8\frac{1}{2} \times 11$ size.

Many publishers, however, are concerned with books of another size, not necessarily $8\frac{1}{2} \times 11$. The system of the present invention will satisfy diverse requirements merely by an alteration in flow and, in some instances, applying the glue bead transversely rather than longitudinally between juxtaposed webs.

Figure 18:
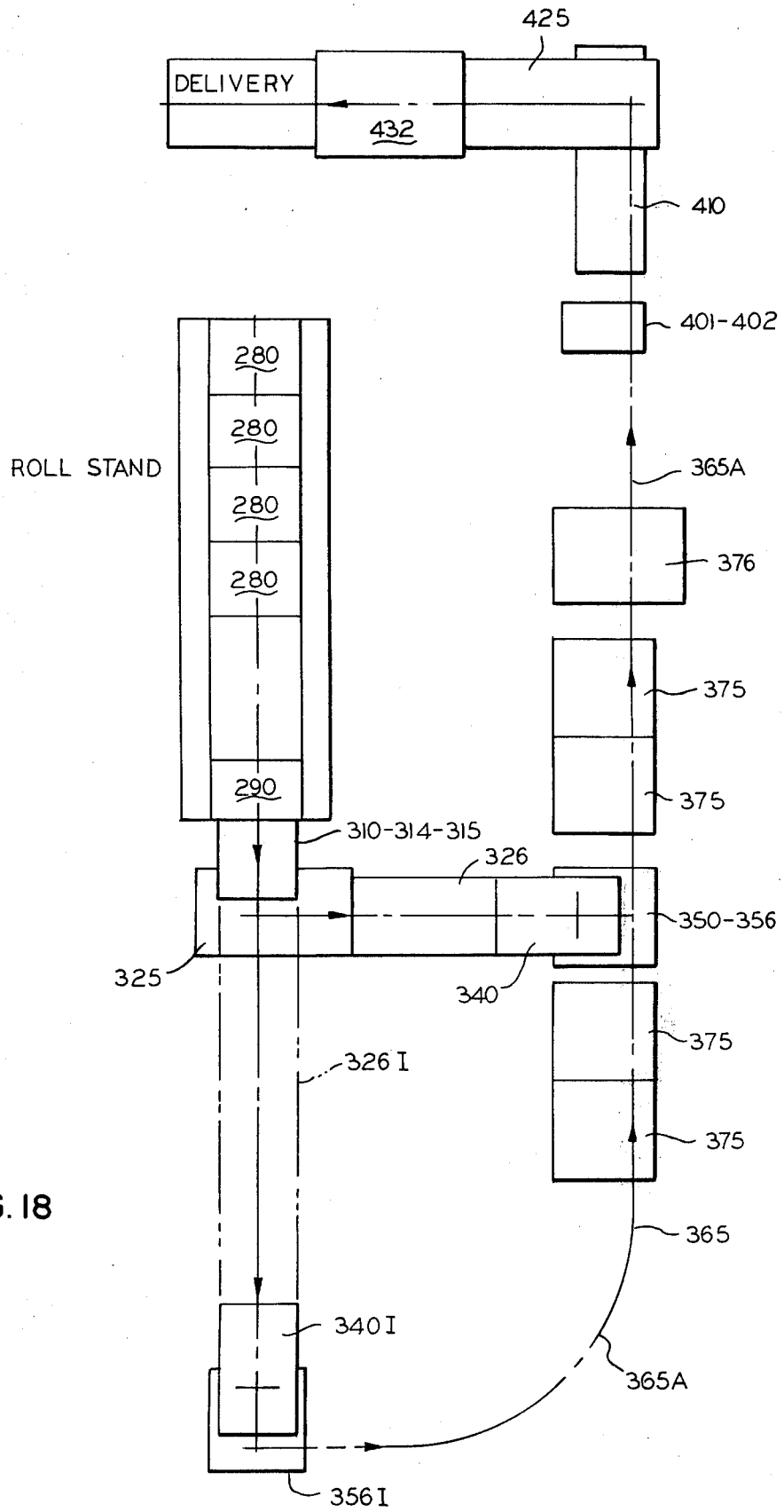

Referring to FIG. 18, the roll stand, cutting cylinder 290 and transfer cylinder 325 are of the form described above, but in this instance web travel is in the direction of the arrow. Folder 340 is of the form described above and receives signatures inverted by the transfer cylinder 325 and transferred to the folder by the transfer conveyor 326 as described above. In fact, $8\frac{1}{2} \times 11$ books 250 are produced precisely in the manner already described, FIG. 19, including the divaricating cylinder 356 for opening the signatures and depositing them on the saddle conveyor. The location of the glue bead is shown by dashed line, FIG. 28. It may be noted, however, that at all times the roll spindles may be supported at one side of the register belt, rather than above, the webs being delivered to the register belt by two turning bars. At all times, when delivering to a saddle conveyor, the folded product, of whatever size, has a lap margin.

Referring again to FIG. 18 the saddle conveyor and related gathering chain are identified by reference character 365, having a turn 365A extending to an optional divaricating cylinder 356I of the kind already described.

An optional transfer conveyor 326I extends to the second divaricating cylinder 356I along an axis coaxial with web travel, FIG. 18.

In order to handle books of another size (I, FIG. 20) the diverting finger 320, FIG. 3, of the transfer cylinder is set to deliver signature pre-forms to the optional transfer conveyor. The reason will now be explained.

The web material (pre-printed and paginated) supplied by the roll stand is again of nominal seventeen inch width and the cutting cylinder cuts at nominal eleven inch intervals. However, the glue is applied transversely between the webs, FIG. 20, as shown by the dashed line in FIG. 29. An optional folder 340I is interposed between conveyor 326I and cylinder 356I, FIG. 18, foldingalong the glued back which is the dashed line in FIG. 20. The signature, $5\frac{1}{2} \times 17$, is delivered to the optional divaricator 356I in turn for delivery to the saddle conveyor in the manner already described except that a folder blade of greater length is used, the fold being made so that a lap edge is created. Also, in this instance, book I is a twin book of sections (A) and (B) which will be separated in a known manner at the trimming station. The sheet product delivered to conveyor 326I is not inverted by cylinder 325; consequently pagination is different compared to book 251 described above. This is equally true of the other form of book now to be described.

Figure 21:
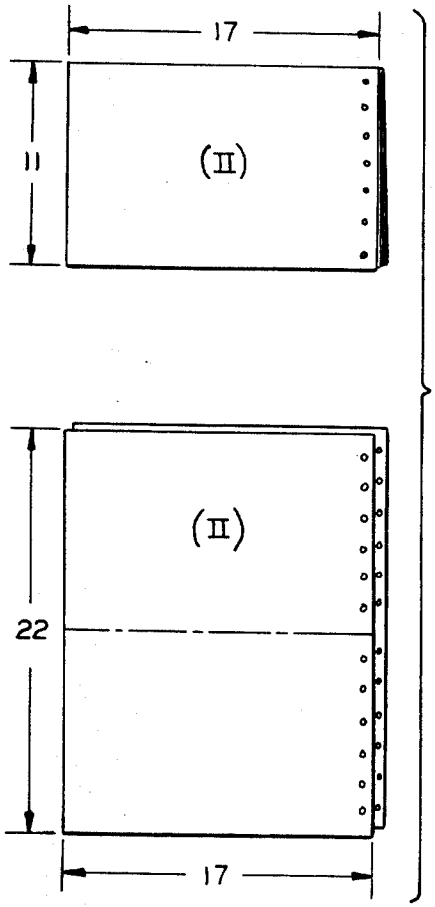
FIGS. 20 and 21 are views of additional forms of book production possible under the present invention.

Another form of book (II) is possible, $11 \times 17$ as shown in FIG. 21, using the same flow path for book (I) but one knife blade is removed from the cutting cylinder 301 so that the jaxtaposed webs are cut at every (nominal) 22 inch interval, folded to $11 \times 17$ size as shown in FIG. 21.

In an actual run of the machine, FIG. 18, only one folder and the related divaricator will be active, depending upon whether the transfer cylinder 325 is set to deliver books to folder 340 or the optional folder 340I. However, the pockets 375 can be utilized in all circumstances, regardless of whether signatures are being delivered from folder 340 to the related divaricator 356 or from folder 340I to the related divaricator 356I.

Figure 20:
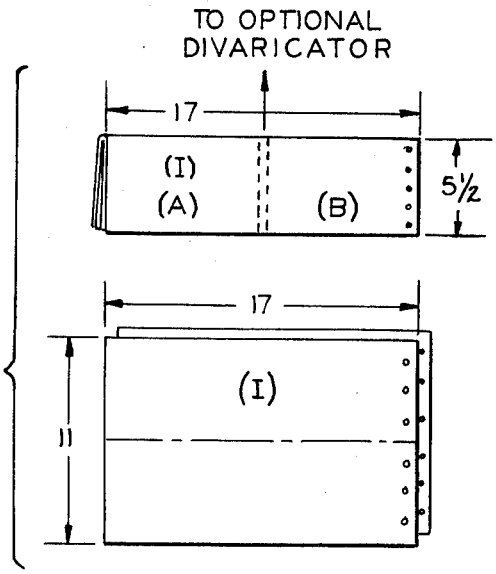
Figure 19:
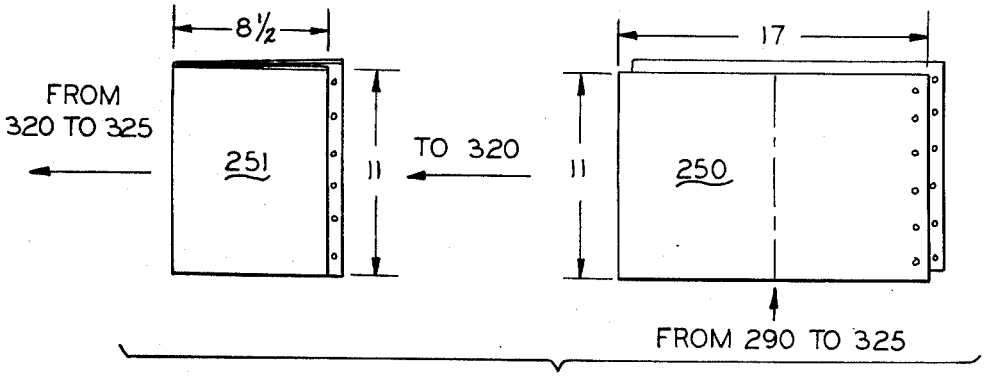
FIGS. 18 and 19 are schematic views of modified book flow.

In FIGS. 19, 20 and 21 only two webs are shown as a matter of convenience; there may be more, of course.

What is claimed is:

1. A machine for producing signatures and forming books therefrom comprising: a signature gathering conveyor, a roll stand having spaced spindles for supplying rolled webs of paginated printed material, means to withdraw web lengths from the rolls and means to register the withdrawn web lengths for proper pagination in justaposed head-to-foot relation, a knife and means to advance the registered webs to the knife along a first predetermined linear path where the webs are severed at a predetermined interval to produce a product of juxtaposed sheets, a first folder spaced laterally from said predetermined path for folding said product into a signature form of given dimension, transfer means including a transfer conveyor to transfer said product to the first folder, said transfer conveyor having a linear path diverging from said predetermined path, means to transfer the signature from the first folder to the gathering conveyor, a linear second transfer conveyor coaxial with said predetermined path and leading to a second folder for folding a signature to a different dimension, means to divert the juxtaposed sheet product emerging from said knife either to said first transfer conveyor or to said second transfer conveyor for delivery either to the first folder or to the second folder where the sheet product is folded into signature form, and signature delivery means to deliver the signature from the second folder to the gathering conveyor.

2. A machine according to claim 1 including means to apply glue between the sheets at the fold line.

3. A machine according to claim 2 wherein the signature gathering conveyor is a saddle conveyor, a signature divaricator being interposed between the conveyor and each folder for opening and depositing the signature on the conveyor, means for delivering other signatures to the conveyor in juxtaposed relation to the glued signature, and means for stitching the juxtaposed signatures gathered by the conveyor.

4. A machine according to claim 1 wherein the signature gathering conveyor is a saddle conveyor and wherein a divaricator for opening the signature is interposed between the conveyor and each folder.

* * * * *